US006315705B1

(12) United States Patent
Eichinger et al.

(10) Patent No.: US 6,315,705 B1
(45) Date of Patent: Nov. 13, 2001

(54) PRESSURE PAD HAVING SCULPTED QUADRANTAL REGIONS

(75) Inventors: Dan Eichinger; Allen Bressler, both of Cedar Rapids, IA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/421,809

(22) Filed: Oct. 20, 1999

(51) Int. Cl.[7] ..... B31B 1/62
(52) U.S. Cl. ..... 493/141; 493/165; 493/184
(58) Field of Search ..... 53/477, 374.2, 53/565, 563, DIG. 2; 493/165, 963, 141, 184; 156/581

(56) References Cited

U.S. PATENT DOCUMENTS

| | | | |
|---|---|---|---|
| 3,120,335 | | 2/1964 | Egleston et al. . |
| 3,422,730 | | 1/1969 | Mitzelfelt et al. . |
| 3,971,300 | | 7/1976 | Bachner . |
| 4,011,800 | | 3/1977 | Walke . |
| 4,403,465 | * | 9/1983 | Bachner . |
| 4,761,156 | | 8/1988 | Bachner et al. . |
| 4,838,847 | | 6/1989 | Kume et al. . |
| 5,135,463 | | 8/1992 | Hyduk . |
| 5,321,930 | * | 6/1994 | Poole . |
| 5,419,801 | * | 5/1995 | McDonald . |
| 5,517,801 | | 5/1996 | Persells et al. . |
| 5,551,211 | | 9/1996 | Kennedy et al. . |
| 5,682,732 | * | 11/1997 | Selberg . |
| 5,713,181 | * | 2/1998 | Giacomelli . |
| 5,762,595 | * | 6/1998 | Santiago et al. . |

* cited by examiner

*Primary Examiner*—Eugene Kim
(74) *Attorney, Agent, or Firm*—Pitts & Brittian, P.C.

(57) ABSTRACT

A pressure pad suitable for use in the heat sealing of a substantial universe of bottom-panel folding designs for closing the bottom of a carton or container. This new pressure pad includes a pattern of sculpting of that surface thereof which is presented to the infolded panels of the bottom of a laminated paperboard carton thereby providing a pressure pad that is substantially universal with respect to its ability to repeatedly effect the desired heat sealing of a plurality of geometrically differing combinations of bottom panels defining the bottom of a paperboard carton.

15 Claims, 8 Drawing Sheets

PRESSURE PAD HAVING SCULPTED QUADRANTAL REGIONS

FIELD OF INVENTION

This invention relates to methods and apparatus for the forming of folded, generally tubular, cartons from cut blanks and particularly to methods and apparatus for forming the closed bottoms of such cartons employing heat and pressure.

BACKGROUND OF INVENTION

In the manufacture or cartons for milk, juices and other liquids in common sizes of quarts, 2-liter and half-gallons, it is common practice to cut blanks of the carton from a sheet of multi-layered, laminated, paperboard which includes a thermoplastic polymeric material, such as polyethylene on its exterior surfaces. These blanks include cut edges which are free of the thermoplastic. The blanks commonly are scored along fold lines to define multiple panels, and subsequently erected into a four-sided tubular geometry. This formed tube is thereafter fitted onto a mandrel having a flat outboard end. While on this mandrel, the bottom-forming panels of the blank are infolded toward the longitudinal centerline of the tube to define a closed bottom of the tube. The infolded bottom panels are captured between the flat end of the mandrel and a pressure pad disposed externally of the tube. Application of heat to the panels and pressure via the pressure pad, effects heat sealing of the bottom-defining panels to one another to complete the bottom.

It will be noted from FIG. 1 herein that each of the outer perimetral edges of a blank is a cut edge. Each such edge is free of thermoplastic material and therefore is susceptible to absorption and wicking of liquid into the interior structure of the paperboard with consequential weakening of the carton wall or bottom.

A typical carton bottom includes at least first and second bottom panels disposed opposite one another across the bottom of the carton and which are designed to be infolded toward the longitudinal centerline of the tubular carton. This infolding defines two multiple-layered generally triangular segments of the bottom, the apices of the triangular segments being disposed adjacent one another at or near the longitudinal centerline of the carton. Others of the bottom panels are of generally rectangular geometry and are infolded toward the centerline of the carton to position their outboard side edges transverse of the carton bottom and lying generally at or adjacent one of the transverse centerlines of the plane of the carton bottom. Each of these other bottom panels commonly comprises a single ply or layer of the paperboard, but as the panels are folded inwardly to define the bottom of the carton, multiple layers of paperboard are developed in certain, but not all, areas of the bottom of the carton. Moreover, (a) the number of layers may vary between one and five layers, for example, (b) the location of the those areas which include more than one layer of paperboard frequently are not contiguous over the bottom of the carton, and (c) the actual area of the bottom which is defined by a given number of layers varies in size (e.g., two or more areas of four layers thickness may be at different locations over the area of the bottom. These and other factors militate against the desired uniform application of that sealing pressure and heat distribution over the area of the bottom of the carton which will result in full effective sealing of the bottom panels. In the prior art, it has been the practice to provide a patterned pressure pad which includes a pattern of raised areas on that surface of the pad which engages the infolded bottom panels. For each folding configuration of the bottom panels of a paperboard carton, heretofore, there has been provided a specifically patterned pad. These prior art pressure pads are basically designed to develop inordinately large pressure in selected regions of the carton bottom in an attempt to over compensate the pressure aspect of the heat sealing operation, the theory being that higher pressure in a given area will ensure a good seal in such area. The result of these prior art pressure pads is deleterious compression of the thickness of the paperboard in these high pressure areas. In use of the carton, these "thin walled" areas of the paperboard tend to develop leaks in the carton, especially the carton bottom.

Each fold in a bottom panel presents a possibility of leakage of liquid into or from the carton. Heat sealing of the bottom panel along the folds thereof is complicated by the relative bulkiness of the panels at these folds. Caution must be exercised in squeezing of the folds in that excessive squeezing of a fold between the pressure pad and the mandrel can create weakened areas in the folds which can be the source of leakage of liquid into or from the carton in the course of its life from formation through consumer use.

Still further, the presence of portions of the cut edges of the blank within the bottom of the carton are particularly susceptible to liquid absorption and wicking. In an effort to reduce the overall exposed area of one or more of the cut side edges of the bottom panels and to permit these side edges to more effectively be sealed within the bottom of the carton, these cut side edges may be skived, then folded back upon themselves and bonded together in an effort to eliminate exposure of a cut edge of the blank to liquid and elimination or reduction of wicking of liquid at the cut edge of the blank. The skived and back-folded side edges of a panel present a still further thickness value (ie, a thickness of more or less than one layer of the paperboard) to be dealt with in the formation of the bottom of the carton. In addition to the consideration of the thickness of the skived and back-folded panel edges, consideration must be given to the width of the back-fold to ensure full sealing of this side edge against the wicking of absorbed liquid along the length dimension of the side edge if liquid happens to bypass other sealing locations associated with the side edge.

All of these militating factors associated with the heat sealing of the bottom panels of a carton bottom are made more problematic by the industry practice of designing different geometric configurations of the bottom panels of the carton. As will be recognized, each different combination of geometric configurations of the bottom panels brings about different heat sealing requirements for each given combination of bottom panels. In one known instance, as many as twenty different bottom panel combinations exist for forming the bottom of a paperboard tubular carton for different liquid contents of the carton. As a consequence, each pressure pad must be especially designed for use with a specific combination of paperboard and folding pattern for a given carton. Thus, when it is desired to change from one bottom folding design to another design, it has been necessary that the carton-forming apparatus be taken off-line and the pressure pads thereof changed. Commonly, carton-forming apparatus includes a plurality of mandrels mounted on a carousel so that many pressure pads must be changed each time there is a switch between bottom folding designs. In addition to the time and expense of this pad changeout procedure, it is required that the manufacturer maintain an inventory of each type of pressure pad, at substantial cost to the manufacturer.

For many years, the industry has sought a pressure pad which is universal with respect to the number of different carton bottom geometrical configurations which can be successfully sealed with the pad. This search has been partially confounded by the further need for locating, i.e., alignment of, the infolded bottom panels of the intended carton bottom with respect to the pressure pad. Misalignment of the pad relative to the infolded panels of the carton bottom can result in each seal being misaligned with respect to the infolded panels. Such misalignment can result in complete or partial failure of seal formation and/or in deleterious thinning out of the paperboard at various locations over the area of the bottom of the carton, such as in the folds, and resultant premature failure of the bottom of the carton in use. In the prior art, as each pressure pad was designed to accommodate a variety of carton bottom designs, the need for proper alignment increased, thereby discouraging the use of such pads.

Further, alignment (ie., spacing apart) of the exposed sculpted surface of the pressure pad relative to the flat surface of a mandrel disposed internally of the tubular carton and in opposition to the pressure pad, is also required to ensure proper separation distance between the mandrel surface and the exposed surface of the pressure pad. Otherwise, there may be more or less of the required pressure applied to the panels of the carton bottom which are captured between the mandrel and pressure pad, with the result being possible rupture of the folds of the panels, incomplete sealing of the panels to one another, and/or the application of excessive pressure in some regions of the bottom, and insufficient pressure in other regions of the bottom. In this respect it is to be noted that known carton-making machines which employ a mandrel fitted inside the tubular carton for forming the closed bottom of the carton, include a pressurized piston-cylinder device mounted in alignment with the mandrel. This cylinder has the pressure pad mounted on the end of the piston for movement of the piston toward and away from the mandrel. Adjustment of the position of the cylinder and its piston and pad mounted thereon relative to the mandrel is provided for so as to permit adjustment of the position of the pressure pad relative to the mandrel.

In one common design for the bottom of a paperboard carton for liquids, a portion of the $^{5}$th panel, integrally bonded to a side edge of one of the bottom panels, extends into the bottom of the carton. This design creates unusual sealing problems so that alignment of the pad and mandrel in this area of the carton bottom has been used for aligning the pad and mandrel. Heretofore, it has been the practice to attempt a first trial alignment of the pad and carton bottom, perform a few trial sealing operations, and then visually observe whether the "stake" seals associated with the $5^{th}$ panel are properly aligned with the $5^{th}$ panel. If misalignment was observed, the entire alignment process was repeated until proper alignment was achieved.

SUMMARY OF INVENTION

In accordance with one aspect of the present invention, the inventors have discovered a pressure pad which is suitable for use in the heat sealing of a substantial universe of bottom-panel folding designs. This new pressure pad includes a pattern of sculpting of that surface thereof which is presented to the infolded panels of the bottom of a laminated paperboard carton which provides a pressure pad that is substantially universal with respect to its ability to repeatedly effect the desired heat sealing of a plurality of geometrically differing combinations of bottom panels defining the bottom of a paperboard carton.

To this end, the present inventors provide a pressure pad having that surface thereof which is presented to the infolded plurality of panels which make up the bottom of a carton, sculpted substantially in quadrants of the overall area of the bottom of the carton. The quadrants are defined by first and second diagonals mutually intersecting at the center of the pad and projecting therefrom through respective opposite corners of the pad to virtually divide that surface of the pressure pad which engages the infolded panels that define the bottom of the carton into substantially quadrantal regions, each of said quadrantal regions having one of their apices disposed at the center of the pad and each of their other apices disposed at a corner of the pad. In a preferred embodiment, an opposite two of the virtual quadrantal regions are of a size less than the virtual quadrantal regions defined by the two diagonals of the pad, and an opposite further two of the virtual quadrantal regions are of a size greater than the virtual quadrantal regions defined by the two diagonals of the pad. By this means, the oblique side edges of a first quadrantal region overlap into side margins of adjacent third and fourth quadrantal regions, and the oblique side edges of a second quadrantal region overlap into others of the side margins of the adjacent third and fourth quadrantal regions.

At least one of the quadrantal regions includes a first sculpted projection having a flat outboard surface disposed substantially parallel to the central cross-sectional plane of the pad and extending to a first height from that surface of the pad facing the mandrel and defining a platform for establishing the separation distance between the pad and the mandrel.

Further, each of the quadrantal regions includes a sculpted surface including at least one further projection extending from the sculpted surface of the pad and defining a flat outboard surface which faces the mandrel and which is oriented in a plane that is essentially parallel to the cross-sectional plane of the pressure pad, and which extends to a height from that surface of the pad facing the mandrel, such height being less than the first height and being a function of the wall thickness of the paperboard from which the carton is formed. In selected areas of the present pressure pad, reliefs may be defined as desired to receive therein portions of the bottom panels of the carton.

In a specific embodiment, each projection or relief is adapted to accommodate the application of that pressure required for heat sealing differing thicknesses of the paperboard, such as the common triangular portions of infolded bottom panels, (gussets) which include multiple layers of the paperboard. Still further areas of the surface of the pressure pad are sculpted to accommodate the sealing of a stretch of skived side edge of one or more of the bottom panels.

In one aspect of the present invention, the inventors have found that displacement of the outer extremes of at least some of the sculpted areas of the pad, in spaced apart relationship from the folds formed by the infolding of the gussets of the panels, reduces the likelihood that the bottom sealing operation will adversely affect the fold itself and tend to create a possible source of future leakage.

In accordance with another aspect of the present invention, alignment of the pressure pad with the bottom of the carton is achieved by alignment of centrally disposed triangular areas of the pad, with portions of the sides edges of facing apices of the two opposing infolded gussets which comprise the multi-layered triangular folds of the bottom. This feature substantially reduces the time and effort required to achieve proper alignment of the pad with the bottom, and assures that all the out-lying pressured areas generated by the pad will be located properly relative to their desired locations and that each of the heat seals generated through the use of the pressure pad will be consistently disposed in the desired location relative to the bottom of the carton.

DETAILED DESCRIPTION OF INVENTION

Figure 1:
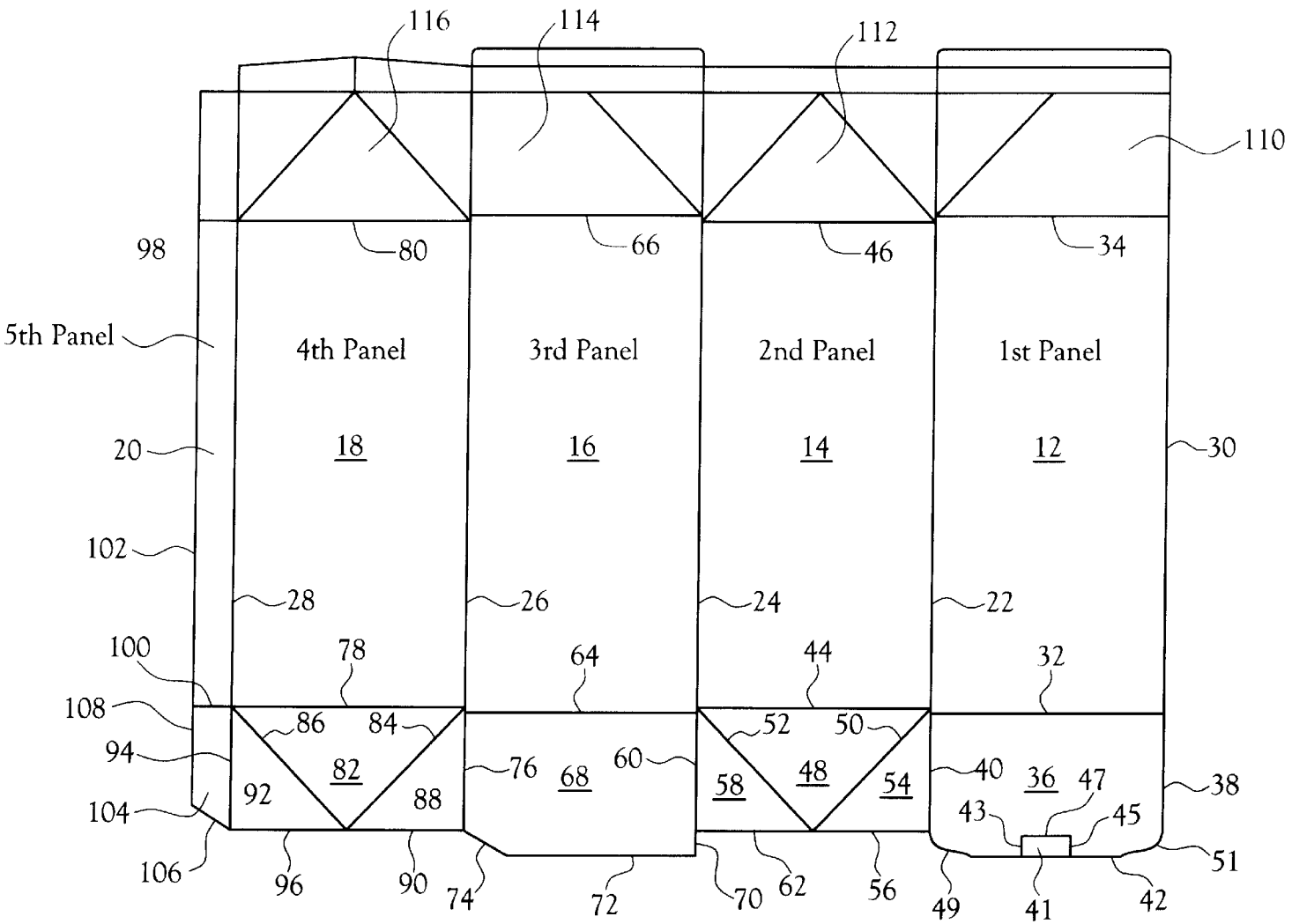
FIG. 1 is a plan view of a typical prior art blank from which a carton of the type referenced herein may be formed.
Figure 2A:
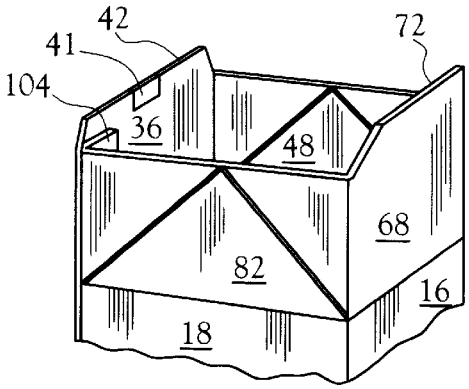
FIGS. 2*a*–2*d* are perspective views of a "J"-bottom end of a carton and depict the process of infolding of the bottom panels of the blank to close and form the bottom of the carton.

With reference to FIG. 1, a typical blank for a prior art carton of the gable-top variety is identified generally by the numeral 10. The prior art blank 10 includes first through fourth rectangular side wall panels 12, 14, 16, and 18 and heat-sealable side glue panel ($5^{th}$ panel) 20 which are consecutively articulated to one another along parallel fold lines 22, 24, 26 and 28 respectively. The first side wall panel 12 is further defined by a raw edge of paperboard material 30 which extends parallel to the fold line 22. A first bottom fold line 32 and a first top fold line 34 extends between the raw edge 30 and the fold line 22 to further define the first side panel 12.

A first bottom panel 36 is articulated to the first side panel 12 of the blank 10 along the first bottom fold line 32. The first bottom panel 36 is further defined by a side raw edge 38 which extends generally colinearly from the raw edge 30. The first bottom panel 36 is further defined by a fold line 40 which extends colinearly from the fold line 32 and by a bottom raw edge 42 which extends between the side raw edge 38 and the fold line 40. The bottom raw edge 42 typically will be disposed at an interior location on the gable carton formed from the prior art blank 10. In the depicted embodiment, the bottom raw edge 42 includes a rectangular tab 41 disposed centrally of the length of the raw edge 42 and defined by first and second cuts 43 and 45 and a fold line 47. Further, the opposite ends of the raw edge 42 are provided with cutaway portions 49 and 51 which aid in the insertion of this raw edge during the infolding of the bottom panels to define the bottom of the carton.

The second side panel 14 is further defined by a second bottom fold line 44 and a second top fold line 46. A second bottom panel 48 is articulated to the second side panel 14 along the second bottom fold line 44. The second bottom panel 48 is further defined by converging fold lines 50 and 52. A triangular web panel 54 is articulated to the second bottom panel 48 along the fold line 50 and is articulated to the first bottom panel 36 along the fold line 40. The triangular web panel 54 is further defined by a raw edge 56 extending between the fold lines 40 and 50. Similarly, a triangular web panel 58 is articulated to the second bottom panel 48 along fold line 52. The triangular web panel 58 is further defined by fold line 60 which extends colinearly from the fold line 24 and by raw edge 62 which extends between the fold lines 52 and 60.

The third side panel 16 of the blank 10 is further defined by a third bottom fold line 64 and a third top fold line 66. A third bottom panel 68 is articulated to the third side panel 16 along the third bottom fold line 64. The third bottom panel 68 is articulated to the bottom web panel 58 along fold line 60 and is further defined by a side raw edge 70 extending colinearly from the fold line 60 and generally orthogonal to the raw edge 62 of bottom web panel 58, a transverse raw edge 72 which extends orthogonally from the side raw edge 70 a major distance across the third bottom panel 68; and, diagonal raw edge 74 which extends between the bottom raw edge 72 and the fold line 76. As will be explained further below, the third bottom panel 68 defines an external wall on the carton erected from the blank 10 and the raw edges 70–74 of the third bottom panel 68 are substantially exposed on exterior regions of the carton.

The fourth side panel 18 of the blank 10 is further defined by a fourth bottom fold line 78 and a fourth top fold line 80 which extend orthogonally between the fold lines 26 and 28. A fourth bottom panel 82 is articulated to the fourth side panel 18 along the fold line 78. The fourth bottom panel 82 is further defined by converging fold lines 84 and 86. A triangular bottom web panel 88 is articulated to the third bottom panel 68 along fold line 76 and is further articulated to the fourth bottom panel 82 along fold line 84. The web panel 88 is further defined by a raw edge 90 which extends orthogonally to the fold line 76 to the intersection of fold lines 84 and 86. The triangular bottom web panel 92 is further defined by a raw cut edge 96 which extends orthogonally from the fold line 94 to the intersection of fold lines 84 and 86.

The heat sealable side panel 20 of the blank 10 is further defined by top and bottom fold lines 98 and 100 and by a raw side edge 102. A bottom heat sealable panel 104 is articulated to the web panel 20 along fold line 100 and to the heat sealable side panel 20 along fold line 100. The bottom heat sealable side panel 104 is further defined by a diagonal raw edge 106 and a side raw edge 108 which extends colinearly from the side edge 102.

In the blank depicted in FIG. 1, the edge 42 of the bottom panel 36 is provided with a tab 41 disposed centrally between the opposite ends of the edge 42. This tab is formed by cuts 43 and 45 which extend perpendicularly from the edge 42, and inwardly of, the panel 36. A fold line 47 is provided for facilitating the folding of the tab 41 back upon the panel 36. This aspect of the blank is at times referred to in the art as a "J-fold".

The blank 10 depicted in FIG. 1 is also provided with a plurality of top panels indicated generally by the numerals 110–116. These top panels are foldable to define the well-known gable top closure of the carton. These panels are not pertinent to the present invention.

The prior art blank 20 is commonly cut and scored by the paperboard manufacturer. The paperboard manufacturer also typically will fold the heat sealable panels 20 and 94 (and pertinent portions of the top panels) relative to the remainder of the prior art blank 10 about the colinear fold lines 28, and 94, respectively. The entire blank 10 will further be folded substantially in half about the colinear fold lines 24 and 60. The heat sealable panels 20 and 104 will be adhered to sides for the first side panel 12 and the first bottom panel 36. It will be appreciated that in the condition described above, the folded blank will be substantially flat with the first side panel 12 being in substantially face-to-face relationship with the fourth side panel 18 and with second side panel 14 being in substantially face-to-face relationship with the third side panel 16. The folded blank 10 then typically will be shipped from the paperboard manufacturer to the dairy or producer of some other liquid to be stored in the carton formed from the blank 10.

The dairy or other such producer of liquid to be stored in the carton formed from the blank 10 will have equipment for forming and sealing the ends of the carton. The equipment will be operative to form the collapsed blank 10 into a generally tubular open ended structure. The bottom end of the tubular structure is closed by rotating the second and fourth bottom panels 48 and 82 inwardly about the second and fourth bottom fold lines 44 and 78 respectively. The first and third bottom panels 36 and 68 will then be rotated inwardly about the first and third bottom fold lines 32 and 64 respectively. This latter folding is carried out such that the first bottom panel 36 leads the third bottom panel 68. Thus, the bottom raw edge 42 of the first bottom panel 36 will be disposed interiorly relative to the third bottom panel 68. However, the side raw edge 38 of the first side bottom panel 36 will be substantially exposed along a bottom edge of the carton formed from the blank 10 as shown in FIGS. 3A–3D. Similarly, the raw edges 70–74 of the third bottom panel 68 will be exposed in a position extending substantially centrally across the bottom of the carton formed from the blank 10. The folded bottom panels 36, 48, 68 and 82 are adhered in overlapping relationship to one another by an appropriate heat sealing operation. This step of the carton forming process is carried out by placing the tubular carton with its folded bottom onto a mandrel having an outboard flat surface (See FIG. 11) as is well known in the art. The sealing of the bottom of the carton is achieved by appropriate application of heat to the bottom panels, followed by pressure from the pressure pad working against the mandrel.

The paper board material from which the prior art blank 10 is formed is a laminate which includes a major layer of a fibrous material having a natural tendency to absorb liquids. The opposed faces of the blank 10 typically will be coated with a thermo plastic to render these faces heat sealable, among other reasons. However, raw edge regions of the cut blank 10 are capable of absorbing liquid, and function as wicks which enable the liquids to travel from one location in the paperboard material to another location. Absorption of liquids and wicking from edge regions of the heat sealable panels disposed interiorly of the carton, including bottom heat sealable side panel 104, can be prevented by grinding away all or a major portion of the paperboard material along the raw edge but leaving the coating. The remaining coating can then be folded over the raw edge of the remaining paperboard material to effectively seal this interiorly disposed edge and prevent absorption and wicking i.e., developing a skived edge 102,108. This action narrows the heat sealable panels 20,104.

Figure 3A:
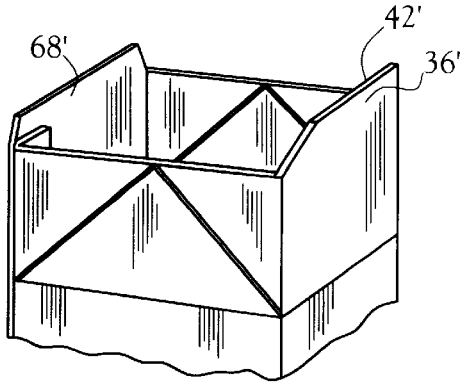
FIGS. 3*a*–3*d* are perspective views of the bottom end of a further carton and depict a further process of infolding of the bottom panels of the blank to close and form the bottom of the carton.
Figure 2B:
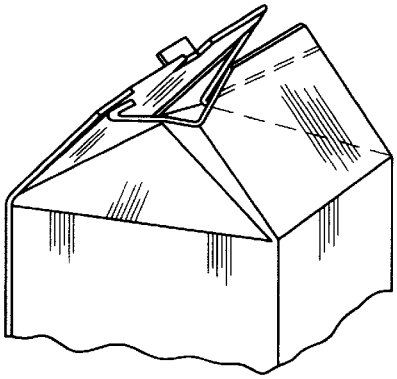
Figure 3B:
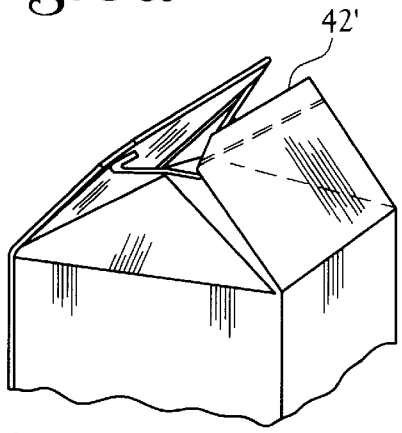
Figure 2C:
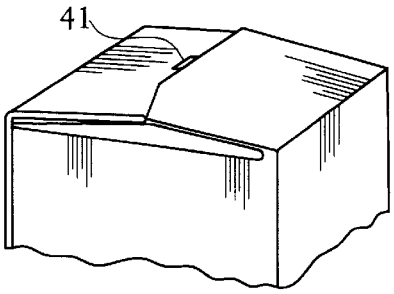
Figure 3C:
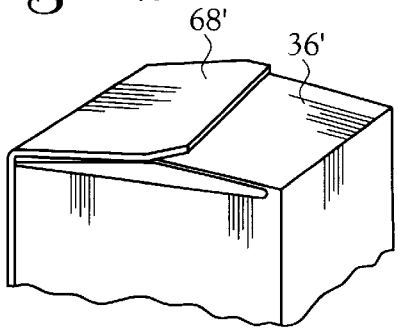
Figure 2D:
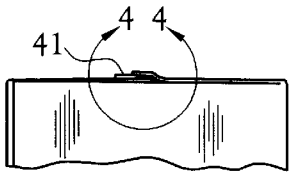
Figure 3D:
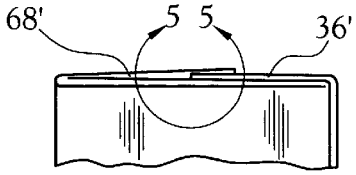
Figure 4:
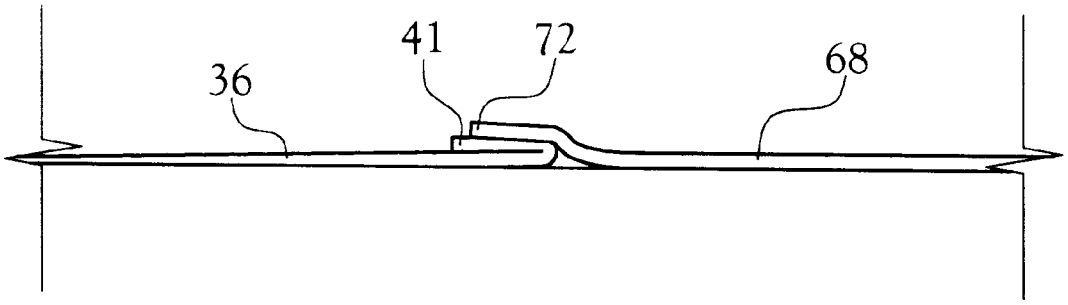
FIG. 4 is a partial sectional view taken generally along the line 4—4 of FIG. 2*d* and depicting the back folding of a portion of one cut edge of a bottom panel.
Figure 5:
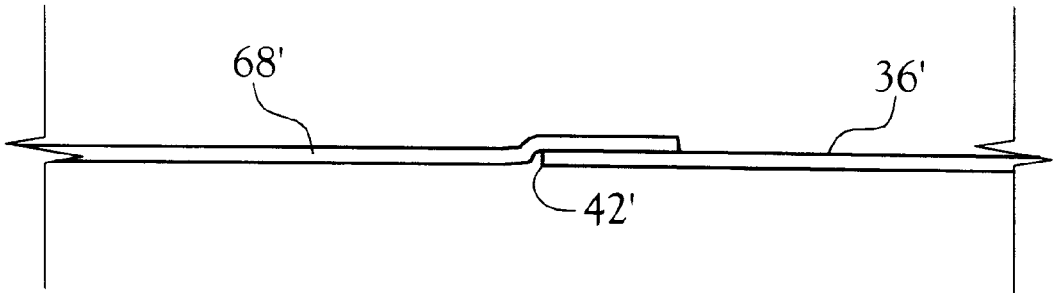
FIG. 5 is a partial sectional view similar to FIG. 4 and taken generally along the line 5—5 of FIG. 3*d*, and depicting a one cut edge of a bottom panel underlying a further cut edge of a further panel.

FIG. 4 depicts a cross-sectional view of one embodiment of the bottom of a carton wherein the panel of the blank includes a tab 41 which is folded back upon the panel 36. In this embodiment, the tab is partially overlaid by the edge 72 of the panel 68 as depicted in FIGS. 2*a*–2*d*. In the embodiment of FIGS. 3*a*–3*d* and 5, there is depicted a similar cross-section of the bottom of a carton wherein panel 68' is overlaid panel 36', without a back folding panel such as panel 41 of FIGS. 2*a*–2*d*, and exposing the raw edge 42', which is in underlying relationship to panel 68', as depicted in FIGS. 3*a*–3*c*. FIG. 5 a cross sectional view of FIG. 3*d*, and depicts a view of the bottom of a carton in which the edge 42' of panel 36' is exposed in an underlying relationship to the panel 68'. Other versions of the infolding of the bottom panels of the carton will be recognized by one skilled in the art.

Referring to FIGS. 6–8 and 11, in one embodiment, the pressure pad 120 of the present invention comprises a rigid solid square/rectangular block of metal, such as a stainless steel alloy having first, second, third and fourth side edges 121, 123, 125 and 127, (see FIGS. 6–8) respectively, first and second transverse centerlines 129 and 135, respectively, (FIGS. 6 and 7) a cross-sectional plane 192, and a longitudinal centerline 133 extending through the thickness dimension of the pad. The pad is essentially non-compressible and does not flex under the pressure applied thereto in the course of forming the bottom of a carton.

The depicted pad 120 includes a first surface 122 which is intended to be mounted on a mounting block 121 which is adjustable secured, as by a bolt 123, on the outboard end 124 of the reciprocating piston rod 126 of a piston-cylinder device indicated generally by the numeral 128 as is well known in the industry. In the preferred embodiment, the pad 120 is releasably secured to the mounting block as by means of bolts 130, 132. As is also well known in the art, the piston-cylinder device is mounted so as to be adjustable with respect to its position relative to a mandrel 134 onto which a tubular carton 136 is fitted in position for heat sealing of the infolded bottom panels of the carton bottom. These infolded bottom panels are indicated generally by the numeral 138 in FIG. 11 and are depicted as being captured between the flat outboard surface 140 of the mandrel 134 and an exposed surface 142 of the pressure pad 120. Typically, in the course of forming and closing the bottom of a carton, the carton is placed on the mandrel, the bottom panels are infolded and heated to the fusion temperature of the thermoplastic outer layer of the paperboard laminate. The mandrel is then rotated to align the heated infolded bottom panels between the outboard end of the mandrel and the pressure pad. Thereupon, the piston-cylinder device is activated and the pressure pad is urged against the heated infolded bottom panels with a preselected pneumatic pressure, such as about 100 psi. The force of the applied pneumatic pressure is evenly distributed over the entire surface 142 of the pad. The movement of the pressure pad toward the mandrel is limited to a preselected separation distance between the pressure pad and the mandrel. Thus, if the surface 142 of the pressure pad were uniformly flat and aligned substantially parallel to the outboard flat surface of the mandrel, the entire area of the infolded bottom panels which are captured between the pad and the mandrel will experience only about 5000 lbs of force.

Figure 6:
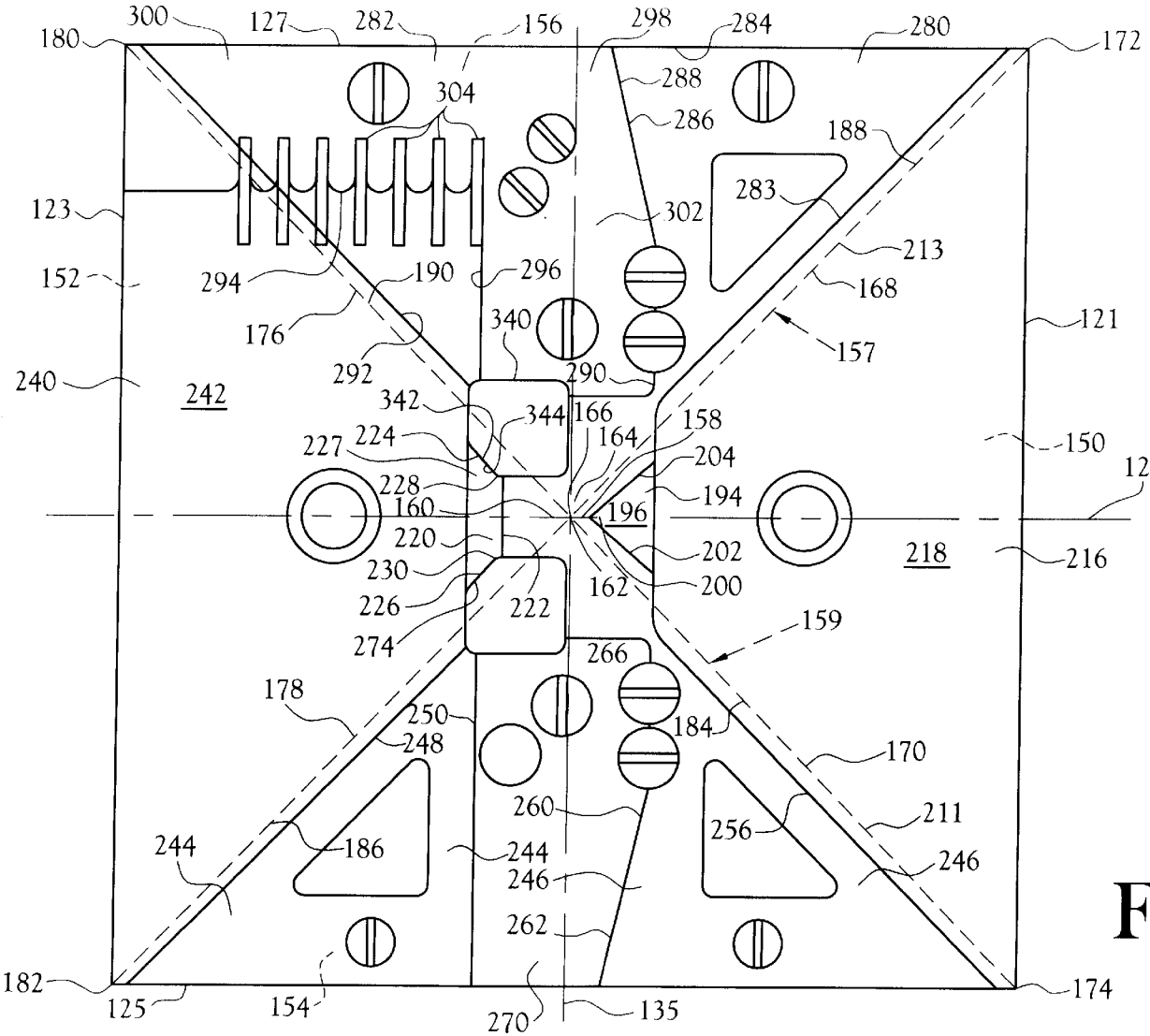
FIG. 6 is a plan view depicting sculpted surface of a pressure pad embodying various of the features of the present invention.
Figure 8:
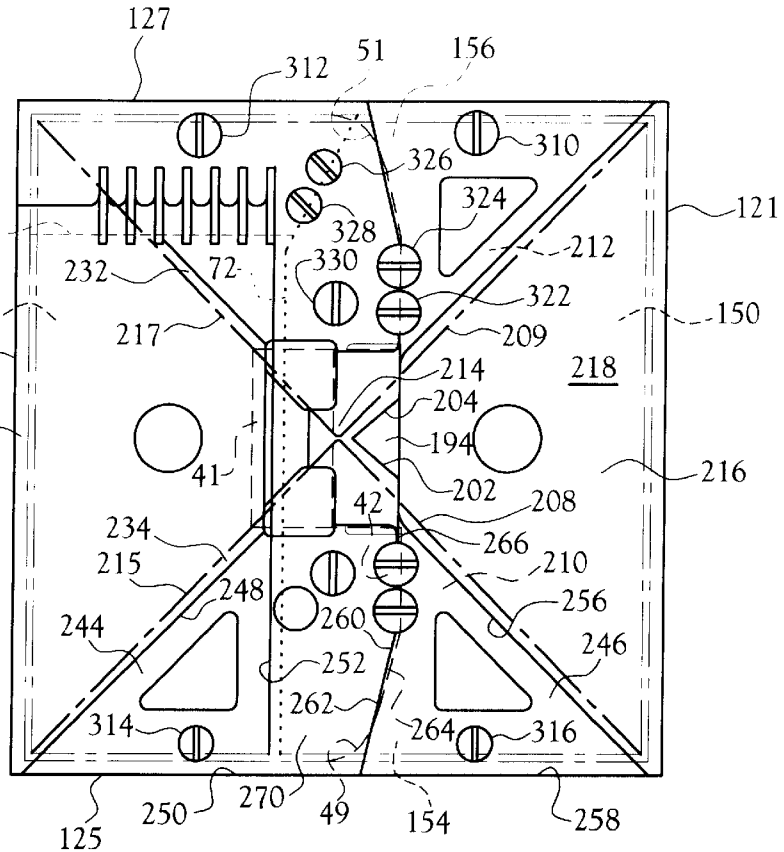
FIG. 8 is a plan view as in FIG. 6, and partially depicting a carton bottom overlaid over the depicted pad.
Figure 7:
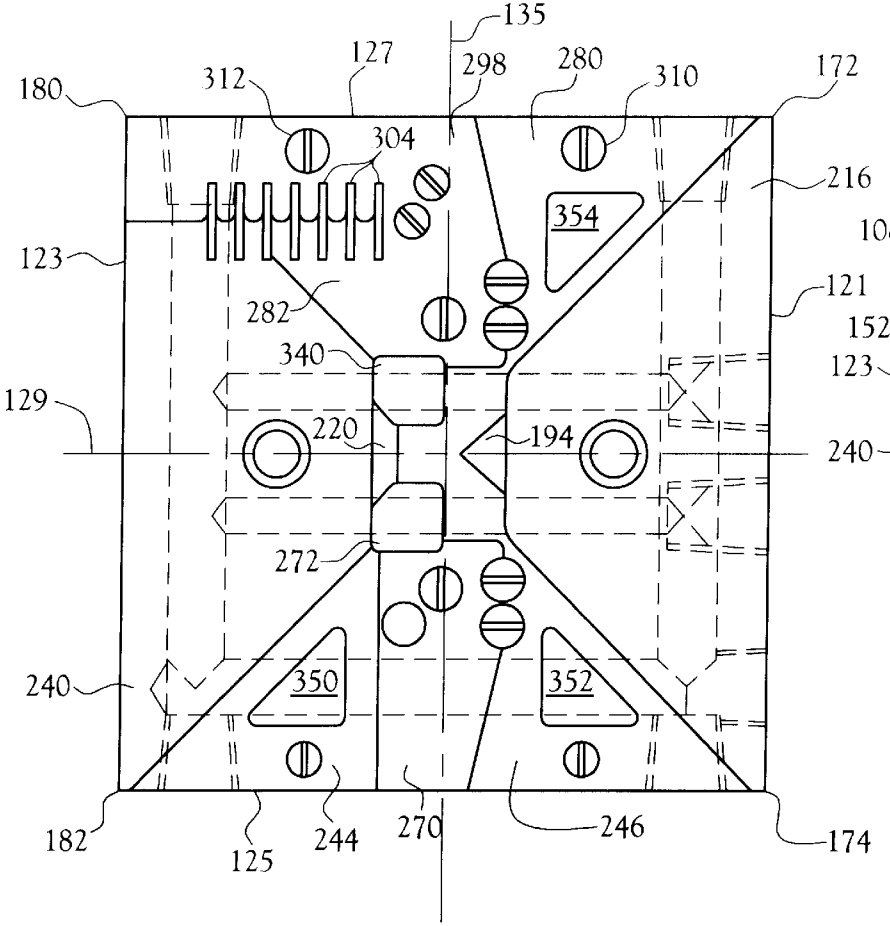
FIG. 7 is a plan view as in FIG. 6, and including coolant conduits depicted in phantom within the interior of the pad of FIG. 6.
Figure 9:
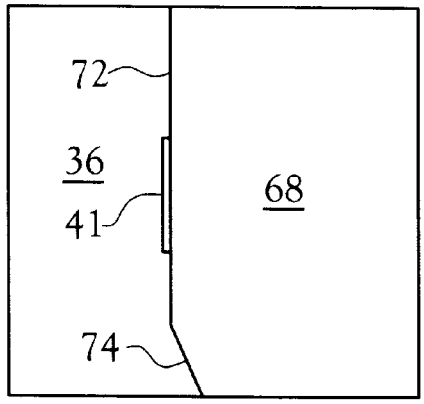
FIG. 9 is a plan view of the exterior surface of one embodiment of a carton bottom formed employing a pressure pad of the present invention.
Figure 10:
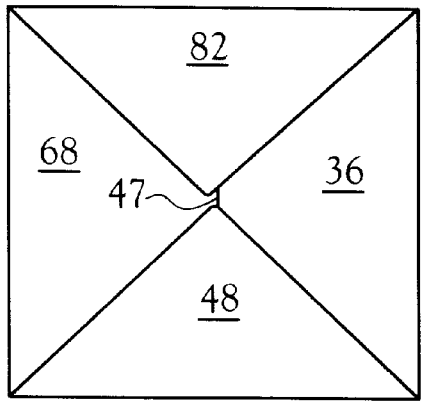
FIG. 10 is a plan view of the interior surface of the carton bottom depicted in FIG. 9.

With reference to FIGS. 6–8, and recalling that FIG. 8 depicts a carton bottom overlaid over the exposed surface of a pressure pad as depicted in FIGS. 6 and 7, the outboard surface 142 (FIG. 11) of the pressure pad of the present invention which faces the mandrel is sculpted to selectively adjust the pressure experienced by different areas of the bottom of the carton, as a function of the number of layers of paperboard that are present in a given area, when the pressure pad is urged into engagement with the infolded panels of the carton bottom. In accordance with one aspect of the present pressure pad, the outboard surface of the pressure pad is virtually (as opposed to "literally") divided into first, second, third and fourth quadrantal regions, 150, 152, 154, and 156, respectively, as by diagonals 157, 159. The apices 158, 160, 162, and 164 of the quadrantal regions converge on the center 166 of the surface 142 of the pad. The side edges 168, 170 of the first quadrantal region extend from the center of the pad, diagonally to intersect the corners 172, 174 of the pad. In like manner, the side edges 176, 178 of the second quadrantal region extend from the center of the pad, diagonally to intersect the corners 180, 182 of the pad. The side edges 184, 186 of the third quadrantal region are common with the side edges 170 and 178, respectively, of the first and second quadrantal regions 150 and 152. Further, the side edges 188,190 of the fourth quadrantal region extend from the center of the pad, diagonally to intersect the corners 172 and 180 of the pad. The side edges 188, 190 of the fourth quadrantal region are common with the side edges 168 and 176, respectively, of the first and second quadrantal regions 150 and 152.

Figure 11:
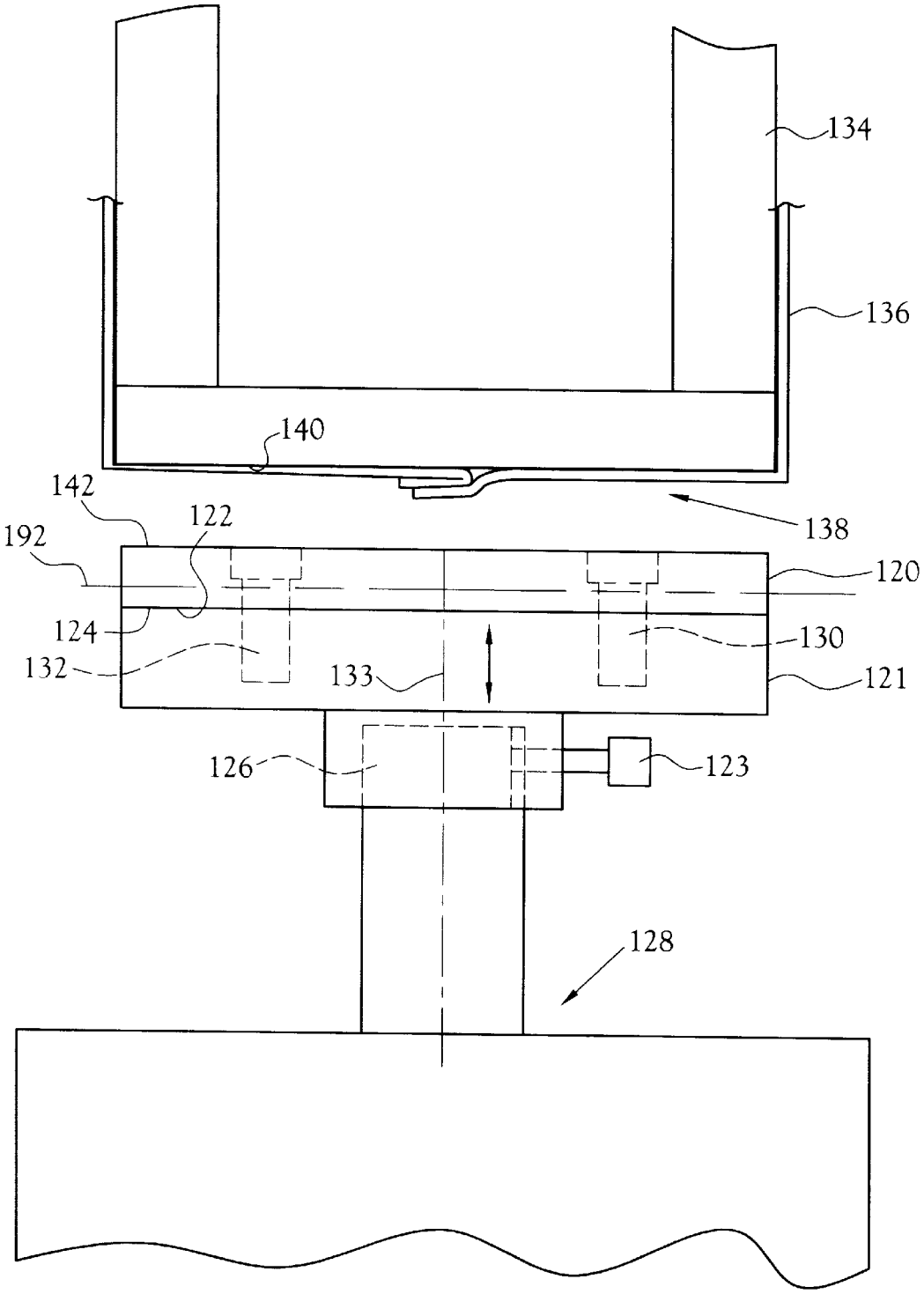
FIG. 11 is a schematic representation of a bottom-forming portion of carton-forming device; and, FIG. 12 is a graphic representation of the relationship of the height of a projection relative to the thickness of paperboard disposed between the projection and the mandrel.

Within each of the quadrantal regions, there is provided at least one sculpted projection extending from the pad in a direction generally perpendicularly from the outboard surface 142 of the pad and having a flat outboard surface 196 facing the mandrel. Preferably, the flat outboard surface of each such sculpted projection is oriented substantially parallel to the cross-sectional plane 192 of the pad (see FIG. 11) and faces the mandrel when the pad and mandrel are aligned as depicted in FIG. 11.

In the embodiment of the pressure pad of the present invention depicted in FIGS. 6–8, the first quadrantal region includes a first projection 194 extending from the pad in a direction generally perpendicularly from the outboard surface 142 thereof to a first height. This projection includes a flat outboard surface 196 which defines a platform for establishing a separation distance between the pad and the mandrel. This separation distance, in the depicted embodiment, establishes the stopping point of the movement of the pad toward the mandrel in a heat sealing operation, and as a point of reference from which the height of all other sculpted areas of the pad surface are established. By this means, the present invention provides for the magnification within selected areas or regions of the pressure pad of the overall pressure with which the pad is urged toward the mandrel. For example, the 5000 lbs overall force employed can be increased in selected areas or regions of the pressure pad through the sculpted projections of the present invention as a function of the number of layers of paperboard present in a given area of the carton bottom. Each projection presents a flat surface having an area which is less than the total area of the exposed surface 142 of the pad.

As depicted, a first projection 194 is of a generally triangular cross-section. The apex 200 of this cross-section is disposed at the center 166 of the pad and its side edges 202 and 204 are aligned substantially parallel to the side edges 168 and 170, respectively, of the first quadrantal region 150, but spaced apart therefrom. The spacing between the side edge 202 and the side edge 170 (see FIG. 8 also) accommodates therein a portion of the apical region of one side edge fold 208 of a first one 210 of first and second triangular gussets 210 and 212 formed by the infolding of the bottom panels 48 and 82. Similarly, the spacing between the side edge 204 of the projection 194 and the side edge 168 accommodates therein a portion of the apical region of a side edge fold 209 of the second gusset 212. As depicted, each of the side edge folds 208 and 209 of the gussets 210 and 212, respectively, are substantially coincidental with respective legs 211 and 213 of the diagonals 170 and 168 respectively.

Between the area of the flat surface 196 of the first projection 194 and the mandrel, in the depicted embodiment, there is disposed only a single thickness of paperboard when tab 41 is back folded. However, due to the proximity of projection 194 to the side edge folds 208 and 209 of the gussets 210 and 212, the height of the flat surface 196 is selected to be sufficient to result in no material compression of the single layer of paperboard. By this means, the side edge folds of each gusset are undamaged by excessive crushing there of by the applied sealing pressure.

The major remaining area of the first quadrantal region 150 comprises a second sculpted projection 216 having a flat surface 218 which projects to a height which is less than the height of the first projection 194 by an amount which is substantially equal to one-half the wall thickness of the paperboard times the number of layers of paperboard disposed between the area of the second projection and the mandrel. By this means, the pressure to which that area of the paperboard which is disposed between the flat surface 218 and the mandrel is subjected to only that pressure which compresses each layer (thickness) of the paperboard to its wall thickness. E.g., when the pressure pad is urged to its closest proximity to the mandrel during a heat sealing operation, the separation distance between the flat surface 218 of the second projection and the mandrel is substantially equal to the wall thickness of the depicted single layer of paperboard disposed within the area of the flat surface 218. Thus, in the area where no heat sealing of the paperboard is desired, there is minimal, if any, compression of the wall thickness of the paperboard.

As depicted in FIGS. 3*a*–3*d*, when tab 41 is not employed, between the area of the flat surface 196 of the first projection 194 and the mandrel, there is disposed a double thickness of paperboard. However, due to the proximity of projection 194 to the side folds 208 and 209 of the triangular gussets 210 and 212, the height of the flat surface 196 is sufficient to result in that degree of displacement of the double layers of paperboard which will effect bonding of the overlying layers of paperboard in this crucial central area of the carton bottom where multiple-layered portions of the carton bottom exist in close, even contiguous, relationship to one another.

Within the second quadrantal region 152 there is provided a sculpted projection 220 of generally truncated triangular cross section extending from the pressure pad. The truncated end 222 of this cross-section is disposed adjacent the center 166 of the pad and the oblique portions 224 and 226 of its side edges 228 and 230 are aligned substantially parallel to the side edges 176 and 178, respectively, of the fourth and third quadrantal regions 156 and 154, respectively, but spaced apart therefrom. The spacing between the oblique side portions 226 and 224, and the sides edges 178 and 176 (see FIG. 8) accommodates therein a portion of the apical region of a first side edge fold 215 of the first one 210 of the first and second triangular gussets 210 and 212 and a portion of the apical region of a first side edge fold 217 of the second gusset 212, respectively.

The major remaining area of the second quadrantal region 152 comprises a third sculpted projection 240 having a flat surface 242 which projects to a height which is less than the height of the first projection 194 by an amount which is substantially equal to one-half the wall thickness of the paperboard times the number of layers of paperboard disposed between the area of the third projection 240 and the mandrel. By this means, the pressure to which that area of the paperboard which is disposed between the flat surface 242 and the mandrel is subjected to only that pressure which compresses each layer (thickness) of the paperboard to its original wall thickness. E.g., when the pressure pad is urged to its closest proximity to the mandrel during a heat sealing operation, the separation distance between the flat surface 242 of the second projection and the mandrel is substantially equal to the wall thickness of the single layer of paperboard disposed within the area of the flat surface 242. Thus, in the area where no heat sealing of the paperboard is desired, there is minimal, if any, compression of the wall thickness of the paperboard, thereby retaining the strength and structural integrity of the paperboard.

Within the third quadrantal region 154 there are provided fifth and sixth sculpted projections 244 and 246, respectively, each of which extends from the pressure pad to a height which is less than the first height by a distance approximately equal to the thickness of the paperboard from which the carton is formed. The fifth projection 244 is of a substantially right triangular cross-section having its side opposite 248 disposed along the side edge 178 of the second quadrantal region and spaced apart therefrom by a distance sufficient to receive therein the first folded side edge 215 of the first gusset 210 (see FIG. 8). By this means, the side opposite 248 of the fifth projection 244 is spaced inwardly of the first side edge fold 215 of the first gusset 210 so that the fifth projection applies sealing pressure to the gusset up to, but not directly to, first side edge fold 215. Thus, in a sealing operation, the first side edge fold 215 of the first gusset 210 is not unduly compressed to the extent that this fold is damaged and becomes a possible source of leakage of liquid into or from the carton or into the interior of the paperboard with resultant weakening of the integrity of the paperboard in the area of this fold.

The first adjacent side 250 of the fifth projection is coincident with a portion of third side edge 125 of the pad and the second adjacent side 252 of the fifth projection 244 is disposed substantially parallel to, but spaced apart from, the second transverse centerline 135 of the pad.

The sixth projection 246 is also of a substantially right triangular cross-section having its side opposite 256 disposed along the side edge 170 of the second quadrantal region 150 and spaced apart therefrom by a distance sufficient to receive therebetween the second folded side edge 208 of the first gusset 210 (see FIG. 8). By this means, the side opposite 256 of the sixth projection 246 is spaced inwardly of the second folded side edge 208 of the first gusset 210 so that the sixth projection applies sealing pressure to the gusset up to, but not directly to, second folded side edge 208. Thus, in a sealing operation, the second side edge fold 208 of the first gusset 210 is not unduly compressed to the extent that this fold is damaged and becomes a possible source of leakage of liquid into or from the carton or into the interior of the paperboard with resultant weakening of the integrity of the paperboard in the area of this fold. A first adjacent side 258 of the sixth projection 246 is coincident with a portion of the side edge 125 of the pad. The second adjacent side 260 of the sixth projection includes a first leg 262 which extends obliquely from the side edge 125 of the pad inwardly of the pad a distance sufficient to cause this leg 262 to overlie a tapered portion 264 (see FIG. 1) of the end edge 42 of the panel 36 when the bottom panels are infolded and captured between the pad and the mandrel. A second leg 266 is disposed substantially parallel to the second transverse centerline 135 of the pad and extends from the inward end of the first leg 262 to the intersection thereof with the side opposite 256 of the sixth projection.

Between the adjacent side 250 of the fifth projection and the adjacent side 260 of the sixth projection there is defined a seventh projection 270 which is disposed within the third quadrantal region and which is at a height which is less than the first height by a distance substantially equal to about twice the thickness of the paperboard from which the carton is formed.

Substantially within the third quadrantal region there is provided a eighth projection 272 of multiple sides which extends to a height which is less than the first height by a distance equal to approximately one-fourth the thickness of the paperboard from which the carton is formed. This eighth projection is disposed within the apical area 162 of the third quadrantal region and is generally of a rectangular cross-section having one of its corners truncated to define an oblique side 274 thereof. This truncated corner portion of the eighth projection extends out of the third quadrantal region and into the second quadrantal region such that the oblique side 274 thereof is aligned parallel to and generally along the side edge 178 of the second quadrantal region and is coincident with the oblique portion 226 of the third projection 220 disposed within the second quadrantal region. This eighth projection is thereby disposed in position to overlie one end of the tab 41 which is folded back upon the bottom panel 36 when the bottom panels are infolded to define the bottom of the carton, plus overlie a portion of the apical end of the first folded side edge 215 (see FIG. 8) of the first gusset 210 to provide enhanced pressure toward sealing of this side edge of the gusset to itself and to that portion of the tab which underlies the apical end of the side edge of the gusset.

Within the fourth quadrantal region of the depicted pressure pad there are provided ninth and tenth sculpted projections 280 and 282, respectively, each of which extends from the pressure pad to a height which is less than the first height by a distance approximately equal to the thickness of the paperboard from which the carton is formed. The ninth projection 280 is of a substantially right triangular cross-section having its side opposite 283 disposed along the side edge 168 of the second quadrantal region and spaced apart therefrom by a distance sufficient to receive therein the first folded side edge 209 of the second gusset 212 (see FIG. 8). By this means, the side opposite 283 of the ninth projection is spaced inwardly of the first side edge fold 209 of the second gusset 212 so that the ninth projection applies sealing pressure to the gusset up to, but not directly to, first side edge fold 209. Thus, in a sealing operation, the first side edge fold 209 of the second gusset 212 is not unduly compressed to the extent that this fold is damaged and becomes a possible source of leakage of liquid into or from the carton or into the interior of the paperboard with resultant weakening of the integrity of the paperboard in the area of this fold.

The first adjacent side 284 of the ninth projection is coincident with a portion of third side edge 127 of the pad.

The second adjacent side 286 of the ninth projection includes a first leg 288 which extends obliquely from the side edge 127 of the pad inwardly of the pad a distance sufficient to cause this leg 288 to overlie a tapered portion 51 (see FIG. 1) of the side edge 42 of the panel 36 when the bottom panels are infolded and captured between the pad the mandrel. A second leg 290 is disposed substantially parallel to the second transverse centerline 135 of the pad and extends from the inward end of the first leg 288 to just short of the projected intersection of the second leg 290 and the side opposite 282 of the ninth projection.

The tenth projection 282 is also of a substantially right triangular cross-section having its side opposite 292 disposed along the side edge 176 of the second quadrantal region 152 and spaced apart therefrom by a distance sufficient to receive therebetween the second folded side edge 217 of the second gusset 212 (see FIG. 8). By this means, the side opposite 292 of the tenth projection is spaced inwardly of the second folded side edge 217 of the second gusset 212 so that the tenth projection applies sealing pressure to the gusset up to, but not directly to, the second folded side edge 217. Thus, in a sealing operation, the second folded side edge 217 of the second gusset 212 is not unduly compressed to the extent that this fold is damaged and becomes a possible source of leakage of liquid into or from the carton or into the interior of the paperboard with resultant weakening of the integrity of the paperboard in the area of this fold.

A first adjacent side 294 of the tenth projection is disposed parallel to, but spaced apart from, a portion of the fourth side edge 127 of the pad and is of a length whereby this first adjacent side 294 is disposed intermediate the first transverse centerline 129 and the fourth side edge 127 of the pad. A second adjacent side 296 of the tenth projection is disposed parallel to, but spaced apart from, the second transverse centerline 135 of the pad such that the first and second adjacent sides 294,296 of the tenth projection, the adjacent side 286 of the ninth projection, a portion of the fourth side 127 of the pad, and a portion of the second side 123 of the pad define therebetween an eleventh projection 298 of generally "L" shaped geometry and which is disposed within the fourth quadrantal region. One leg 300 of this eleventh projection is disposed parallel to the fourth side edge 127 of the pad, and extends from approximately the second transverse centerline line 135 of the pad fully to that corner 180 of the pad which is common to the second and fourth quadrantal regions. The other leg 302 of this eleventh projection is disposed substantially parallel to the second transverse centerline 135 of the pad. This eleventh projection is of a height which is less than the first height by a distance substantially equal to about twice the thickness of the paperboard from which the carton is formed.

Further within the fourth quadrantal region of the pad of the present invention there is provided a plurality of elongated stakes 304, which are aligned with one another and which are disposed transversely of the first adjacent side 294 of the tenth projection. Substantially one-half the length of each stake is disposed on each of the opposite sides of the first adjacent side 294 of the tenth projection so that one-half of each stake is located within the area of the tenth projection 282 and the other half thereof is located within the leg 300 of the eleventh projection 298. That half of each stake which is disposed within the area of the tenth projection extends to a height which is less than the first height by a distance approximately equal to about one-half the thickness of the paperboard from which the carton is formed. That half of each stake which is located within the area of the eleventh projection extends to a height which is less than the first height by a distance approximately equal to about one thickness of the paperboard. In this respect, it is to be noted that the cut side edge 108 of that portion 104 of the $5^{th}$ panel which extends into the bottom of the carton, underlies at least the first adjacent side 294 of the tenth projection. Thus, the stakes 304 are located so that they apply sealing pressure transversely of the cut side edge 108 of the $5^{th}$ panel and ensure sealing of this cut side edge against wicking along the cut side edge of the $5^{th}$ panel of any liquid which may be absorbed through this cut side edge. The height of that half of the stakes which are located within the area of the tenth projection is such as will accommodate the single-layer thickness of the side edge 108. Further, in the event the cut side edge 108 is skived and folded back upon itself, the fold of the side edge 108 falls fully within the area of the leg 300 of the eleventh projection. This skived and folded back side edge presents a paperboard thickness greater than a single thickness of the paperboard, hence the height of those halves of the stakes which are located within the area of the eleventh projection accommodate such increased paperboard thickness(es) to perform a proper seal, but without undue crushing and damage to the side edge 108 of the $5^{th}$ panel.

Optionally, but preferably, one or more further stakes, such as stakes 310–332, may be located at strategic locations on the pad to enhance the assurance of non-wicking of any liquid which may be absorbed into the paperboard through a cut edge thereof.

Substantially within the fourth quadrantal region there is provided a twelfth projection 340 of multiple sides which extends to a height which is less than the first height by a distance equal to approximately one-fourth the thickness of the paperboard from which the carton is formed. This twelfth projection is disposed within the apical area 164 of the third quadrantal region and is generally of a rectangular cross-section having one of its corners 342 truncated to define an oblique side 344 thereof. This portion of the twelfth projection extends out of the third quadrantal region and into the second quadrantal region such that the oblique side 344 thereof is aligned parallel to and generally along the side edge 176 of the second quadrantal region and is coincident with the oblique portion 224 of the third projection 220 disposed within the second quadrantal region. This twelfth projection is thereby disposed in position to overlie one end of the tab 47 which is folded back upon the panel 36 when the bottom panels are infolded to define the bottom of the carton, plus overlie a portion of the apical end of the first folded side edge 217 of the second gusset 212 to provide enhanced pressure toward sealing of this side edge of the gusset to itself and to that portion of the tab which underlies the apical end of the side edge of the gusset.

As noted, the blank 10 depicted in FIG. 1 is representative of the blanks currently employed in the industry. With particular reference to FIG. 8, it is to be noted that the pressure pad of the present invention includes sculpted areas which are located on the exposed surface of the pad in position to overlie a wide variety of combinations of the geometrical designs of the bottom panels depicted in FIG. 1. For example, as depicted in FIGS. 2A–2D and 3A–3D, the bottom panels may or may not included a folded-back tab (at times referred to in the art as a "J-flap") which are presently in common use in the industry. Most all known cartons of the type referenced herein include first and second gussets defined in the infolded bottom panels of the carton. Importantly in the present invention is the fact that the fifth, sixth, ninth and tenth projections provide spacing between their respective side opposites and the respective folded side edges of the two gussets. This separation has been found to reduce the compression of these folded side edges to thereby decrease the incidence of destruction or damage to the folded side edges of the gussets. In one particular embodiment, this separation distance is about 0.030 inch. In accomplishing this aspect of the present invention, it is important that the combined areas of the fifth and sixth projections be less than the overall area of the first gusset which underlies these projections, and in like manner, that the combined areas of the ninth and tenth projections be less than the overall area of the second gusset. Still further, it has been found useful in the present pressure pad to provide a relief 350, 352, and 354 (FIG. 7) in the approximate central area of each of the fifth, sixth and ninth projections, respectively. Each of these reliefs are at a height which is less than the first height by a distance approximately equal to about three thickness of the paperboard thereby providing ample "free" space into which the uncompressed paperboard may move as the outer peripheries of the fifth, sixth and ninth projections compress their respective underlying areas of the gussets.

As also noted, alignment of the present pressure pad with the mandrel, hence the infolded bottom panels overlying the exposed face of the mandrel, to ensure that each of the sculpted projections of the pressure pad register with their desired underlying bottom panel and/or side edge of the bottom panels, is readily accomplished by positioning the first and third generally triangular projections in register with the side edges of the gussets in the apical regions of the gussets, as opposed to the prior art technique of attempting alignment of the plurality of elongated stakes with the side edge of that portion of the $5^{th}$ panel which extends into the bottom of the carton. A further advantage is gained with the present invention by employing the first projection as the "ground-level" from which all other heights of the various projections are set. Use of the first projection in this manner has been found to permit the ready calculation of the heights of all other projections as a function of the number of thickness of paperboard which is to underlie each such other projection. This factor permits the application of substantially uniform pressure per square inch to all areas of the infolded bottom panels which define the bottom of the carton as opposed to the prior art concept of applying greater pressure per square inch over only those areas where there is believed to be a need for "extra" sealing pressure. It is therefore possible when employing the pressure pad of the present invention to choose a given overall pressure per square inch to be applied to the pad and to distribute this same pressure per square inch uniformly over all areas of the sculpted and non-sculpted areas of the exposed surface of the pad. Under these circumstances, in the depicted embodiment of the present pressure pad, no layer of the paperboard is compressed to greater than about one-half its thickness, with the exception of the areas of the gussets which underlay the fifth, sixth and ninth projections. In these areas which need relatively greater compression to ensure good physical contact between the layers of each gusset, there is made available the greater compression of the thicknesses of the layers of paperboard, but notably without deleterious effect upon the sensitive side edge folds of these gussets.

Figure 12:
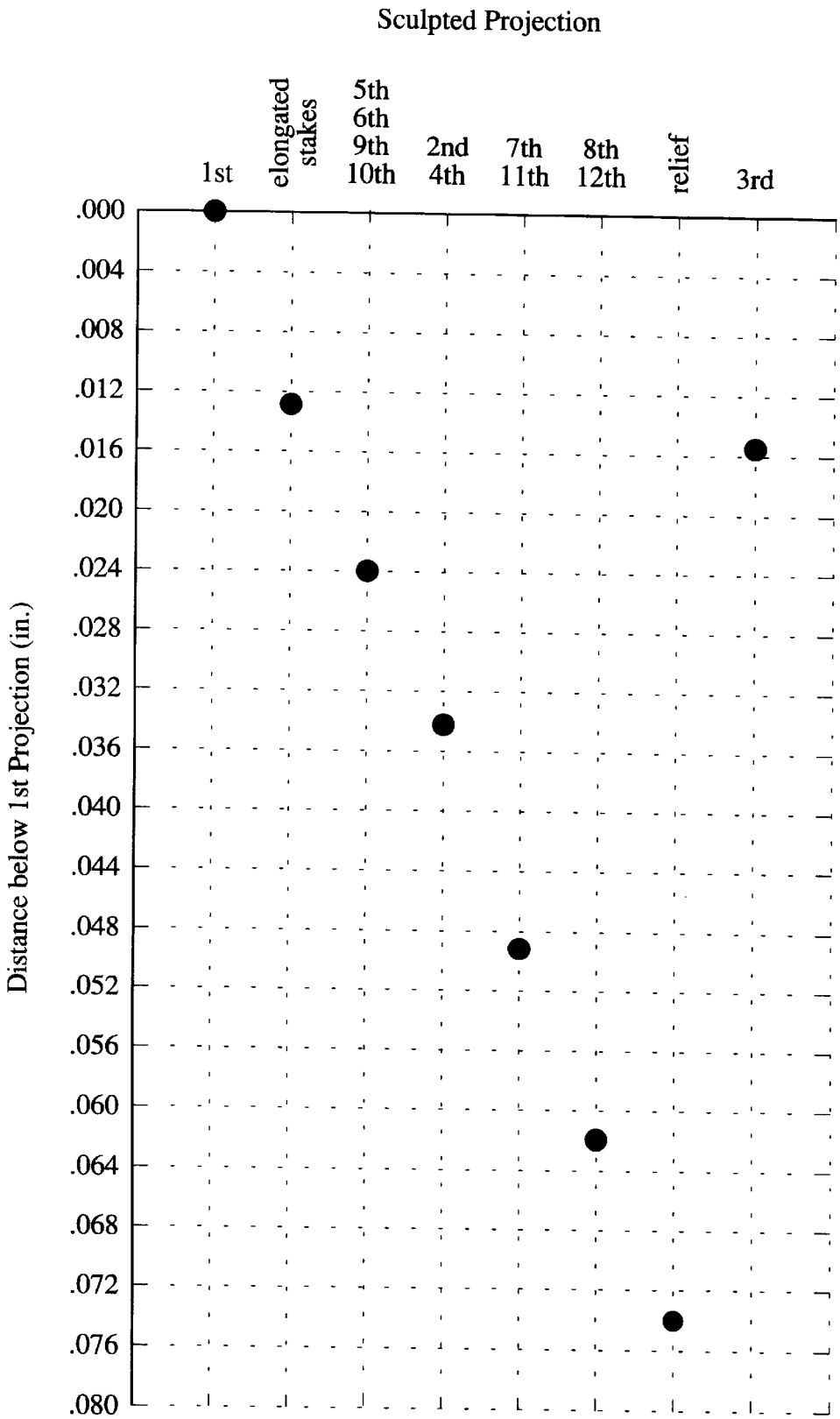

In FIG. 12, there is depicted graphically the relationship of various of the sculpted projections for one embodiment of the present pressure pad. This graph assumes a paperboard thickness of about 0.025 inch and that the height of the first projection is taken as 0.000 inch.

Whereas the present invention has been described in detail, it is to be recognized that variations are possible with respect to certain aspects of the invention and it is intended that the invention be limited only as set forth in the claims appended hereto.

What is claimed:

1. In a generally rectangular rigid pressure pad for use in the formation of the bottom of a carton formed of infolded panels of a paperboard having heat sealable surfaces the pad having first and second opposite surfaces, first, second and third side edges, and including a longitudinal centerline extending through the thickness of the pad normal to the opposite flat surfaces of the pad, first and second transverse centerlines extending between respective opposite sides of the pad, a cross-sectional plane parallel to the opposite flat surfaces of the pad, the first surface of the pad being adapted to engage and apply a sealing pressure against the infolded bottom panels upon capture of the infolded bottom panels between the pressure pad and a mandrel, the improvement comprising:

first and second diagonals mutually intersecting at the longitudinal centerline of the pad and projecting therefrom through respective opposite corners of the pad to virtually divide that surface of the pressure pad which engages the infolded panels into quadrantal regions, each of said quadrantal regions having one of their apices disposed at the center of the pad and each of their other apices disposed at a corner of the pad, an opposite two of said virtual quadrantal regions being of a size less than the other opposite two of said virtual quadrantal regions defined by the two diagonals of the pad, at least one of said quadrantal regions including a first sculpted projection having a flat outboard surface disposed substantially parallel to the cross-sectional plane of the pad and extending to a first height from that surface of the pad facing the mandrel and defining a platform for establishing a separation distance between the pressure pad and the mandrel, each of said quadrantal regions having a sculpted surface including at least a further projection extending from said sculpted surface of the pressure pad and defining a flat outboard surface which faces the mandrel and which is oriented in a plane that is essentially parallel to the cross-sectional plane of the pressure pad, and which extends to a height which is less than said first height and being a function of the wall thickness of the paperboard.

2. The improvement of claim 1 wherein said height of said flat surface of said second projection is less than said height of said first projection by an amount which is substantially equal to one-half the wall thickness of the paperboard times the number of layers of paperboard disposed between said second flat surface of said further projection and said mandrel.

3. The improvement of claim 2 wherein the area of said flat surface of said second projection approximates the area of that multiple of layers of paperboard which are disposed between said flat surface and said mandrel.

4. The improvement of claim 1 wherein said first sculpted projection is of generally triangular cross section and is disposed within a first one of said quadrantal regions, with the major remainder of said first quadrantal region comprising said second projection and being at a height which is less than the height of said first sculpted projection by an amount equal to approximately one and one-half times the thickness of the paperboard from which the carton is formed, one apex of said first sculpted projection being disposed adjacent the center of the pad and with the adjacent sides of its cross section aligned along the adjacent sides of said first one of said quadrantal regions.

5. The improvement of claim 4 and including a third sculpted projection of generally truncated triangular cross section extending from the pressure pad to a second height which is less than said first height by a distance equal to approximately one-half the thickness of the paperboard from which the carton is formed and within a second one of said quandrantal regions, with the remainder of said second quadrantal region comprising a fourth sculpted projection and being at a height which is substantially equal to the height of said second projection of said first quadrantal region, the truncated apex of said third sculpted projection being disposed adjacent the center of the pad and with the adjacent sides of its cross-section aligned along the adjacent sides of said second quadrantal region, said second quadrantal region being disposed opposite said first quadrantal region whereby said first sculpted projection and said second sculpted projection partially define a space therebetween.

6. The improvement of claim 5 and including fifth and sixth sculpted projections extending from the pressure pad to a height which is less than said first height by a distance approximately equal to the thickness of the paperboard from which the carton is formed and within a third one of said quadrantal sculpted regions.

7. The improvement of claim 6 and including an eighth projection of multiple sides extending from the pressure pad to a height which is less that said first height by a distance equal to approximately one-fourth the thickness of the paperboard from which the carton is formed, said eighth projection being disposed substantially within said third quadrantal region at a location adjacent the apex of said third quadrantal region and with one side of said eighth projection extending out of said third quadrantal region and into said second quadrantal region wherein said one side of said eighth projection lies alongside one adjacent side of said third projection which is disposed within said second quadrantal region.

8. The improvement of claim 6 and including ninth and tenth sculpted projections, each extending from the pressure pad to a height which is less that said first height by a distance equal to approximately the thickness of the paperboard from which the carton is formed and within a fourth one of said quadrantal regions, said ninth projection having a substantially right triangular cross section having its side opposite disposed along a second side of said first quadrantal region and a first adjacent side of said ninth projection being coincident with a portion of the fourth side edge of the pad, and a second adjacent side of said ninth projection being disposed substantially parallel to, but spaced apart laterally from, the second transverse centerline of the pad.

9. The improvement of claim 8 wherein said ninth projection is disposed adjacent the center of the pad and combines with a portion of the space defined at the center of the pad between said first and second projections and with a portion of the opical area of said third quadrantal region to interconnect said ninth projection and said opical area of said third quandrantal region centrally of the pad, said combined portions being at the same height relative to said height of said ninth projection.

10. The improvement of claim 8 wherein said tenth projection is of a substantially right triangular cross section having its side opposite disposed along one side of said second quadrantal region and having a first adjacent side thereof parallel to, but spaced apart from, a portion of the fourth side edge of the pad, and a second adjacent side of said tenth projection being disposed substantially parallel to, but spaced apart laterally from, the second transverse centerline of the pad to partially define in combination with said second adjacent side edge of said ninth projection, a generally "L"-shaped area extending to a height which is less than said first height by a distance substantially equal to twice the thickness of the paperboard.

11. The improvement of claim 8 and including a relief of generally triangular cross section disposed generally centrally of each of said fifth, sixth and ninth projections.

12. The improvement of claim 1 and including an array of liquid flow channels defined internally of the pad for the transport of coolant therealong.

13. The improvement of claim 6 wherein said fifth projection includes a substantially right triangular cross-section having its side opposite disposed along one side of said second quadrantal region and spaced apart therefrom and one adjacent side of said fifth projection being coincident with a portion of the fourth side edge of the pad, and one adjacent side of said fifth projection being disposed substantially parallel to, but spaced apart from, the second transverse centerline of the pad.

14. The improvement of claim 6 wherein said sixth projection includes a substantially triangular cross-section having its side opposite disposed along a first side of said first quadrantal region and, one adjacent side thereof being coincident with a portion of the third side edge of the pad.

15. In a generally square/rectangular rigid pressure pad having first and second opposite surfaces having first, second, third and fourth side edges, and including a longitudinal centerline extending through the thickness of the pad normal to the opposite flat surfaces of the pad, first and second transverse centerlines extending between respective opposite sides of the pad, and a cross-sectional plane, for use in the formation of the bottom of a carton formed of infolded panels of a paperboard having heat sealable surfaces the first surface of the pad being adapted to engage and apply a sealing pressure against the infolded bottom panels upon capture of the infolded bottom panels between the pressure pad and a mandrel, the improvement comprising first and second diagonals mutually intersecting at the longitudinal centerline of the pad and projecting therefrom through respective opposite corners of the pad to virtually divide that surface of the pressure pad which engages the infolded panels into quadrantal regions, each of said quadrantal regions having one of their apices disposed at the center of the pad and each of their other apices disposed at a corner of the pad, at least one of said quandrantal regions including a first sculpted projection having a flat outboard surface disposed substantially parallel to the cross-sectional plane of the pad and extending to a first height from, that surface of the pad facing the mandrel and defining a platform for establishing a separation distance between the pressure pad and the mandrel, a plurality of sculpted projections extending from each of said quadrantal regions, each of said sculpted projections defining a flat outboard surface which faces the mandrel and which is oriented in a plane that is essentially parallel to the cross-sectional plane of the pressure pad, and which extends to a height which is less than said first height, said height of each sculpted projection being a function of the of the thickness of the paperboard from which the carton is formed, and overlying a portion of the infolded bottom panels from which the bottom of the carton is formed, each such portion constituting an area of the infolded panels which are to be sealed one to another.

* * * * *